US005897446A

United States Patent [19]

Wiseman et al.

[11] Patent Number: 5,897,446

[45] Date of Patent: Apr. 27, 1999

[54] SOCCER TRAINING AID

[76] Inventors: Katherine O. Wiseman, HC3, Box 13 A; Carrie Krause, 2535 Oak Valley Dr., both of New Braunfels, Tex. 78132

[21] Appl. No.: 08/837,826

[22] Filed: Apr. 22, 1997

Related U.S. Application Data

[ 60] Provisional application No. 60/016,004, Apr. 23, 1996.

[51] Int. Cl.[6] ..... A63B 69/00; A43B 5/00; A43B 23/00

[52] U.S. Cl. ..... 473/446; 36/114; 36/136; 36/139

[58] Field of Search ..... 473/438, 446; 36/114, 115, 136, 139

[56] References Cited

U.S. PATENT DOCUMENTS

| | | | |
|---|---|---|---|
| 3,348,842 | 10/1967 | Stern | 473/438 |
| 3,501,144 | 3/1970 | Schmidt | 273/454 |
| 4,204,346 | 5/1980 | Fugere | 36/114 |
| 4,711,043 | 12/1987 | Johnson et al. | 36/139 |
| 5,216,827 | 6/1993 | Cohen | 36/134 |
| 5,433,437 | 7/1995 | Dudley | 273/55 |

*Primary Examiner*—William H. Grieb
*Attorney, Agent, or Firm*—Quarles & Brady

[57] ABSTRACT

A soccer training aid uses a conforming fabric upper attached to a soccer shoe with straps passing between the cleats. The upper provides a foundation for colored targets indicating proper kicking points for soccer.

11 Claims, 1 Drawing Sheet

SOCCER TRAINING AID

CROSS-REFERENCE TO RELATED APPLICATIONS

This application claims priority from provisional application 60/016,004 filed Apr. 23, 1996 and hereby incorporated by reference.

STATEMENT REGARDING FEDERALLY SPONSORED RESEARCH OR DEVELOPMENT

BACKGROUND OF THE INVENTION

The present invention is related to training aids for soccer, and specifically to a device to teach young soccer players the optimum contact areas on each foot for kicking a soccer ball.

Young children's first attempt in organized competitive sports is often on the soccer field. Aspiring soccer players are full of energy and enthusiasm, but often have difficulty in taking directional instructions (e.g., kick the ball with the instep of your right foot) and are easily discouraged when mistakes are made. Consequently, teaching the fundamental kicks used in the game of soccer is a difficult process for even the most experienced coaches.

There are four basic areas of the foot used to propel a soccer ball. They are the inside of the foot; inside of the instep; the instep; and the outside of the foot. Each kick is used for a different purpose, to accomplish different results throughout the game.

Teaching these fundamentals to the novice player should be the main focus for coaches throughout the player's first two to three seasons of play. However, many coaches volunteer with little or no knowledge of these basic kicks or the developmental stage of these young players. Consequently, these players receive little accurate feedback as to the proper execution of these fundamental skills.

Attempts have been made to attach targets to a player's shoes to indicate the correct points of contact between the foot and the soccer ball for various kicks. The difficulty of affixing such a target to a soccer shoe, in a way that will resist the force of a soccer kick, has limited these targets to locations on the instep, that is the top of the foot where the laces of the shoes are located. This single location has limited the usefulness of such attachable targets.

Alternatively, specialized soccer training shoes have been created with colored patches. These shoes provide a greater variety of target areas but are an impractical expense in most junior leagues.

BRIEF SUMMARY OF THE INVENTION

The present invention provides a flexible covering or sock that may fit over a conventional soccer shoe to support targets in arbitrary locations over the soccer shoes' upper.

Specifically, the present invention provides a training aid attachable to a standard soccer shoe. The training aid includes a covering conforming to the upper of the soccer shoe and extending downward to a lower edge near the sole. Straps extend between portions of the lower edge of the covering separated by the sole, the straps being positioned to pass along the bottom of the sole when the covering is in position on the upper. A plurality of targets on the outer surface of the covering are located so that when the covering is in position on the upper, they are over locations on the shoe that would contact a properly kicked soccer ball.

It is one object of the invention to provide a training aid designating arbitrary targets over the surface of the soccer shoe that may be used with standard soccer shoes. The covering conforms to the upper of the soccer shoe permitting targets on the inside and outside of the foot as well as on the instep.

It is another object of the invention to provide such a training aid that may be reliably retained on the soccer shoe. Straps passing beneath the sole of the shoe hold the covering in close conformity to the shoe's upper yet are protected from abrasion by the flanking cleats which they pass between.

The cover may be separable on a parting line positioned near the rear of the shoe when the covering is positioned on the upper.

It is thus another object of the invention to provide a support for kicking targets that may be put on the shoe while the shoe is being worn. By making the cover separable at its rear, the covering may be placed on the shoe by sliding the toe of the shoe forward into the covering without removing the shoe from the foot.

The covering may include a pouch at one end to receive a toe of the shoe when the covering is in position on the upper.

It is yet another object of the invention therefore to firmly attach the covering to the toe of the shoe to resist the typical rearward forces exerted on the covering during a kick.

The covering may be an elastic woven fabric.

It is thus another object of the invention to provide a support for targets for kicking that transfers the force of the kick largely to the shoe thus both resisting movement of the covering and providing the correct feel to the player during the kick.

Two coverings may be used for the left and right foot and they may be given different colors and each of the targets may be given different colors.

Thus it is another object of the invention to assist in the teaching of players who are uncertain as to the distinction between their left and right foot and unfamiliar with the terminology describing parts of the foot.

The foregoing and other objects and advantages of the invention will appear from the following description. In the description, reference is made to the accompanying drawings which form a part hereof and in which there is shown by way of illustration the preferred embodiment of the invention. Such embodiment does not necessarily represent the full scope of the invention however and reference must be made therefore to the claims for interpreting the invention.

DETAILED DESCRIPTION OF THE INVENTION

Figure 1:
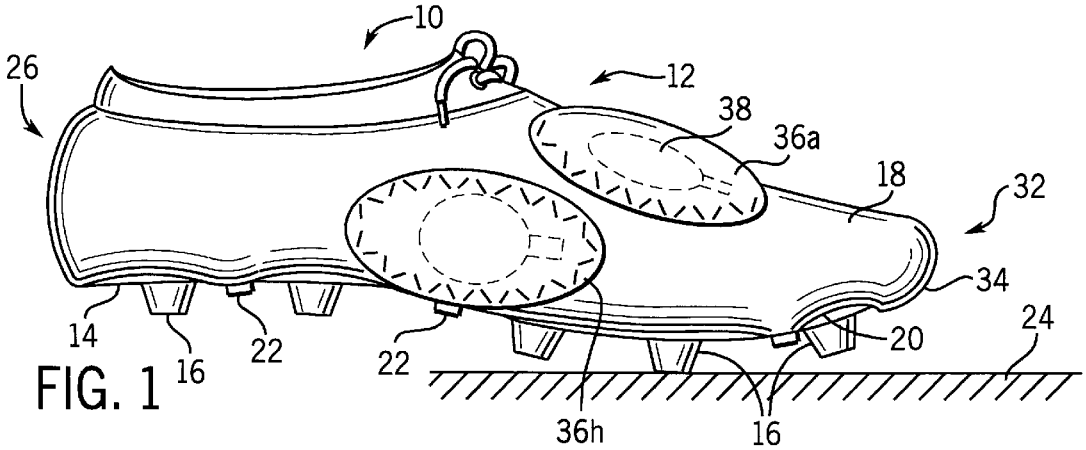
FIG. 1 is a side elevational view of the covering of the present invention in position on a soccer shoe showing noise-makers as placed beneath targets.

Referring now to FIG. 1, a soccer shoe 10 includes generally an upper 12 attached to a sole 14 having downwardly extending cleats 16.

Conforming to and covering the upper 12 of the shoe 10 is a fabric covering 18 constructed of a stretchable woven fabric such as a nylon/rayon or Lycra. The covering 18 extends over the upper 12 conforming generally to its surface and downward toward the sole 14. The lower edge 20 of the covering 18 stops substantially even with the beginning of the sole 14.

Figure 3:
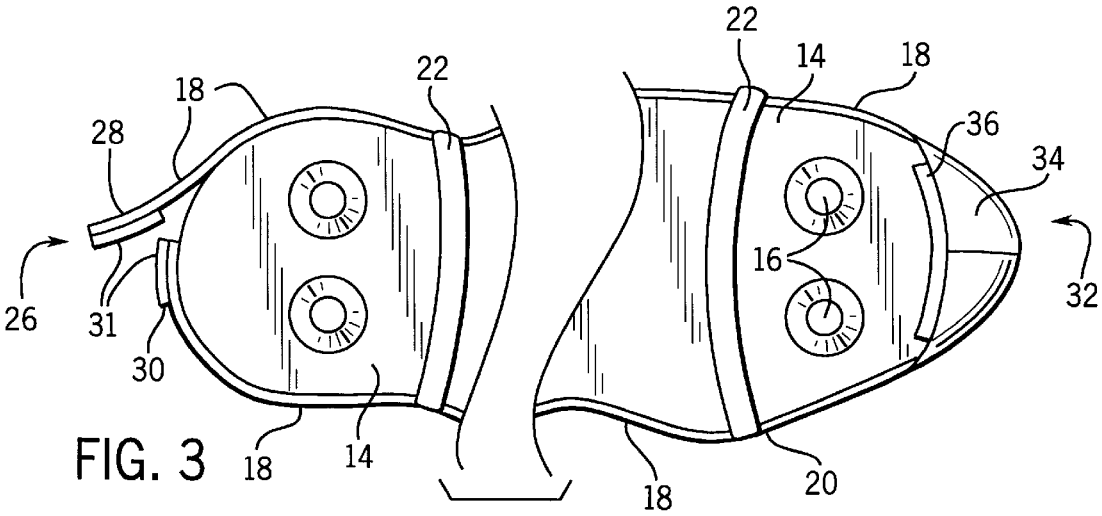
FIG. 3 is a fragmentary bottom plan view of the training aid of FIGS. 1 and 2 showing elastic straps passing beneath the sole of the shoe to hold the covering in place between cleats.

Referring to FIG. 3, elastic straps 22 connect to the lower edge 20 at points opposed across the sole 14 to pull the covering 18 down against the upper 12. The elastic straps 22 extend beneath the sole 14 between cleats 16 and are thus removed from wear and abrasion caused by contact with the ground 24.

Figure 2:
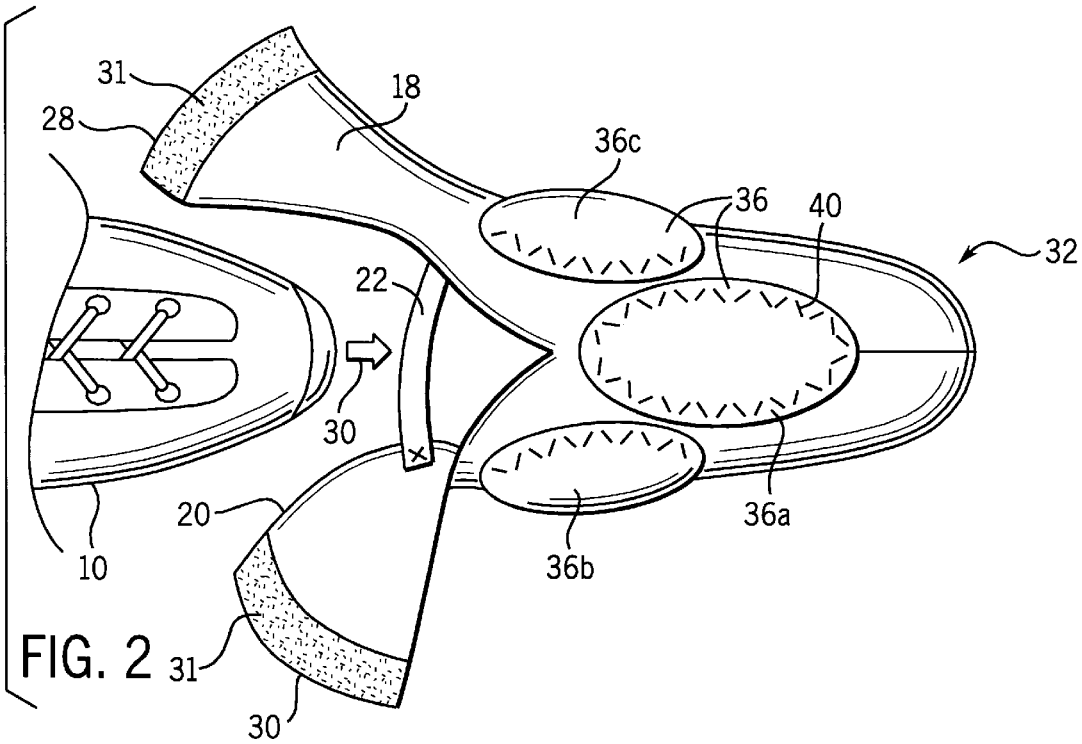
FIG. 2 is a top plan view of the training aid of the present invention opened at its rear edge to permit insertion of a shoe, toe first, into the covering of the invention.

Referring to FIG. 2, the covering 18 may separate along a parting line 26 extending vertically through the covering 18 at the rear of the shoe 10 when the covering 18 is positioned on the shoe 10. Opposite sides 28 and 30 of the parting line 26 may have a releasable fastener 31 so the sides 28 and 30 may be pulled together and joined behind the shoe 10 allowing the covering 18 to surround the upper. 12 of the shoe 10. The fastener 31 may be a Velcro-type hook and eye material.

Referring still to FIG. 2, when the sides 28 and 30 are separated, a shoe 10 may be inserted toe first as indicated by arrow 30 into the covering 18 above the straps 22 but beneath the covering 18. The ability to separate the rear of the covering 18 permits covering 18 to be placed on a shoe 10 or removed from a shoe 10 while the shoe is worn by a player.

A toe portion 32 of the covering 18 forms a pocket 34 that may receive the toe portion of the shoe 10 when the covering 18 is placed on the upper 12. The pocket 34 may be formed and may conform to the toe of the shoe 10 by means of an elastic strip 22 (visible in FIG. 3) whose contraction bunches the lower edge 20 of the covering 18 together to form the pocket 34 with some elasticity in its dimensions.

The pocket 34 helps the covering 18 resist rearward forces such as may be caused by contact with a soccer ball during a properly executed kick, thus preventing the covering 18 together with straps 22 from shifting or loosening during play.

Referring to FIGS. 1 and 2, the outer surface of the covering 18 may include one or more targets 36 indicating locations where the soccer ball should be struck against the shoe 10 for various types of kicks. In the preferred embodiment, at least three such targets 36 are provided.

One target 36*a* is on the instep or top of the foot above the laces of the shoe 10, one target 36*b* is on the inside of the foot toward the arch, and one target 36*c* is opposite the target 36*b* on the outside of the foot. These targets 36 may be colored fabric patches attached against the covering 18 or may be stitched to the covering 18 only around their periphery to provide a pocket enclosing a noise maker 38 that provides an audible signal when the ball is kicked at the particular target. Such noise makers 38 are well known in the art and comprise a resilient hollow bulb communicating with a metal or plastic reed so that when the bulb is squeezed under the force of a kick, air is expelled through the reed causing a squeaking sound. Preferably the noise makers 38 have plastic reeds and bulbs so as to be fully washable. The use of zig zag type stitching 40 provides suitable elasticity in attaching such targets 36 to the covering 18.

The coloring of the covering 18 and targets 36*a* is selected to uniquely identify any target to a young user by color alone. In the preferred embodiment, a covering 18 intended for a right foot will be red and a covering 18 intended for a left foot will be blue so as to identify those feet as the "red foot" or "blue foot", respectively.

Each of the targets 36 for one foot are of different colors but between feet there are same colored targets so that the targets on the two feet have mirror symmetry with respect to their coloring. Thus, for example, target 36*a* for both feet may be orange whereas target 36*b* for both feet may be purple and target 36*c* for both feet may be green.

It will be understood from the above description that the covering 18 may used also in a strictly ornamental capacity or may bear sports or team logos or the like.

The above description has been that of a preferred embodiment of the invention. It will occur to those that practice the art that many modification may be made without departing from the spirit and scope of the invention. For example, it will be understood that additional targets may be placed on the shoe including at the heel and rearward of the targets on the side of the shoe by the simple inclusion of additional target materials and different colors preserving the general coloring scheme as described. It will be further understood that whereas the elastic straps may be sewn to the lower edge of the covering, one side of the strap may be releasable using conventional techniques to permit further adjustment and easier placement of the covering on the shoe.

In order to apprise the public of the various embodiments that may fall within the scope of the invention, the following claims are made.

I claim:

1. A training aid attachable to a standard soccer shoe, the soccer shoe having an upper and a sole with cleats, the training aid comprising;

a fabric covering conforming to the upper of the soccer shoe and extending downward to a lower edge near the sole including a pouch at one end to receive a toe of the shoe when the fabric covering is in position on the upper;

straps extending between portions of the lower edge of the covering separated by the sole, the straps positioned to pass across the bottom of the sole between cleats when the covering is in position on the upper; and a plurality of targets on the outer surface of the covering and located, when the covering is in position on the upper, over locations on the shoe that would contact a properly kicked soccer ball.

2. The training aid of claim 1 wherein the covering is separable at a parting line positioned near the rear of the shoe when the covering is in position on the upper;

whereby the covering may be placed on the shoe by sliding the soccer shoe through an opening formed by a separation of the cover at the parting line.

3. The training aid of claim 2 wherein halves of a releasable fastener are positioned on the covering at either side of the parting line to separably join the covering at the parting line.

4. The training aid of claim 1 wherein an elastic strip is attached to the lower edge to form an edge of the pouch.

5. The training aid of claim 1 wherein the targets incorporate pressure activated sound-makers.

6. The training aid of claim 5 wherein the pressure activated sound makers are hollow, resilient bulbs communicating with an air excited reed.

7. The training aid of claim 1 wherein the covering is a woven fabric.

8. The training aid of claim 7 wherein the woven fabric includes two symmetrical halves joined at a seam running from a toe to a tongue of the shoe when the covering is in position on the upper.

9. The training aid of claim 1 wherein the straps are permanently affixed to the covering and are elastic.

10. The training aid of claim 1 including a second covering, second straps and second plurality of targets similar for use with a second shoe, wherein the coverings are of different colors.

11. The training aid of claim 1 including a second covering, second straps and second plurality of targets similar for use with a second shoe, wherein the targets of each covering are of different colors and where colors of the targets of one covering are in mirror image to the colors of the targets of the other covering.

* * * * *